US005570889A

United States Patent [19]

Tyrer

[11] Patent Number: 5,570,889

[45] Date of Patent: Nov. 5, 1996

[54] HOOK AND LOOP BALL TARGET

[76] Inventor: Paul Tyrer, P.O. Box 38875, Howick, Auckland, New Zealand

[21] Appl. No.: 524,581

[22] Filed: Sep. 7, 1995

[51] Int. Cl.[6] ..... A63B 67/00; F41J 1/10

[52] U.S. Cl. ..... 273/346; 273/407; 273/DIG. 30

[58] Field of Search ..... 273/346, 403, 273/407; 248/462, 463, 464, 465

[56] References Cited

U.S. PATENT DOCUMENTS

| | | | |
|---|---|---|---|
| 392, 565 | 11/1888 | Larew | 248/464 |
| 763,004 | 6/1904 | Krauth | 248/462 |
| 1,076,002 | 10/1913 | Clarke | 273/403 X |
| 2,210,149 | 8/1940 | Levine et al. | 273/403 |
| 2,723,817 | 11/1955 | Harwood et al. | 248/464 |
| 3,980,303 | 9/1976 | Bolton | 273/346 |
| 3,982,762 | 9/1976 | Milicic | 273/416 |
| 4,415,154 | 11/1983 | Engelhardt | 273/346 X |
| 5,123,656 | 6/1992 | Green | 273/400 |
| 5,139,273 | 8/1992 | Rudell et al. | 273/346 |
| 5,211,404 | 5/1993 | Grant | 273/407 |
| 5,280,919 | 1/1994 | Graham | 273/407 X |
| 5,294,130 | 3/1994 | Woods et al. | 273/346 |
| 5,344,155 | 9/1994 | Huang | 273/346 |
| 5,358,742 | 10/1994 | Ziff | 273/346 X |

*Primary Examiner*—William H. Gried

[57] ABSTRACT

A target for engaging and securing a hook and loop ball during play of a game. The inventive device includes a support stand positionable upon a ground surface. A target is supported by the support stand and includes a base web of hook and loop material to which a hook and loop covered ball can be engaged. The target can include various forms of indica printed thereon to facilitate play of a variety of games.

1 Claim, 5 Drawing Sheets

HOOK AND LOOP BALL TARGET

BACKGROUND OF THE INVENTION

1. Field of the Invention

The present invention relates to game structures and more particularly pertains to an hook and loop ball target for engaging a securing a hook and loop ball during play of a game.

2. Description of the Prior Art

The use of game structures is known in the prior art. More specifically, game structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art game structures include U.S. Pat. Nos. 5,280,919; 5,211,404; 5,139,273; 5,123,656; and 3,982,762.

While these devices fulfill their respective, particular objectives and requirements, the aforementioned patents do not disclose a hook and loop ball target for engaging and securing a hook and lop ball during play of a game which includes support stand positionable upon a ground surface, and a target supported by the support stand which includes a base web of hook and loop material through which a hook and loop covered ball can be engaged, wherein the target can include various forms of indica printed thereon to facilitate play of a variety of games.

In these respects, the hook and loop ball target according to the present invention substantially departs from the conventional concepts and designs of the prior art, and in so doing provides an apparatus primarily developed for the purpose of engaging and securing a hook and loop ball during play of a game.

SUMMARY OF THE INVENTION

In view of the foregoing disadvantages inherent in the known types of game structures now present in the prior art, the present invention provides a new hook and loop ball target construction wherein the same can be utilized for engaging and securing a hook and loop ball. As such, the general purpose of the present invention, which will be described subsequently in greater detail, is to provide a new hook and loop ball target apparatus and method which has many of the advantages of the game structures mentioned heretofore and many novel features that result in a hook and loop ball target which is not anticipated, rendered obvious, suggested, or even implied by any of the prior art game structures, either alone or in any combination thereof.

To attain this, the present invention generally comprises a target for engaging and securing a hook and loop ball during play of a game. The inventive device includes a support stand positionable upon a ground surface. A target is supported by the support stand and includes a base web of hook and loop material to which a hook and loop covered ball can be engaged. The target can include various forms of indica printed thereon to facilitate play of a variety of games.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hook and loop ball target apparatus and method which has many of the advantages of the game structures mentioned heretofore and many novel features that result in a hook and loop ball target which is not anticipated, rendered obvious, suggested, or even implied by any of the prior art game structures, either alone or in any combination thereof.

It is another object of the present invention to provide a new hook and loop ball target which may be easily and efficiently manufactured and marketed.

It is a further object of the present invention to provide a new hook and loop ball target which is of a durable and reliable construction.

An even further object of the present invention is to provide a new hook and loop ball target which is susceptible of a low cost of manufacture with regard to both materials and labor, and which accordingly is then susceptible of low prices of sale to the consuming public, thereby making such hook and loop ball targets economically available to the buying public.

Still yet another object of the present invention is to provide a new hook and loop ball target which provides in the apparatuses and methods of the prior art some of the advantages thereof, while simultaneously overcoming some of the disadvantages normally associated therewith.

Still another object of the present invention is to provide a new hook and loop ball target for engaging and securing a hook and loop ball during play of a game.

Yet another object of the present invention is to provide a new hook and loop ball target which includes support stand positionable upon a ground surface, and a target supported by the support stand which includes a base web of hook and loop material through which a hook and loop covered ball can be engaged, wherein the target can include various forms of indica printed thereon to facilitate play of a variety of games.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
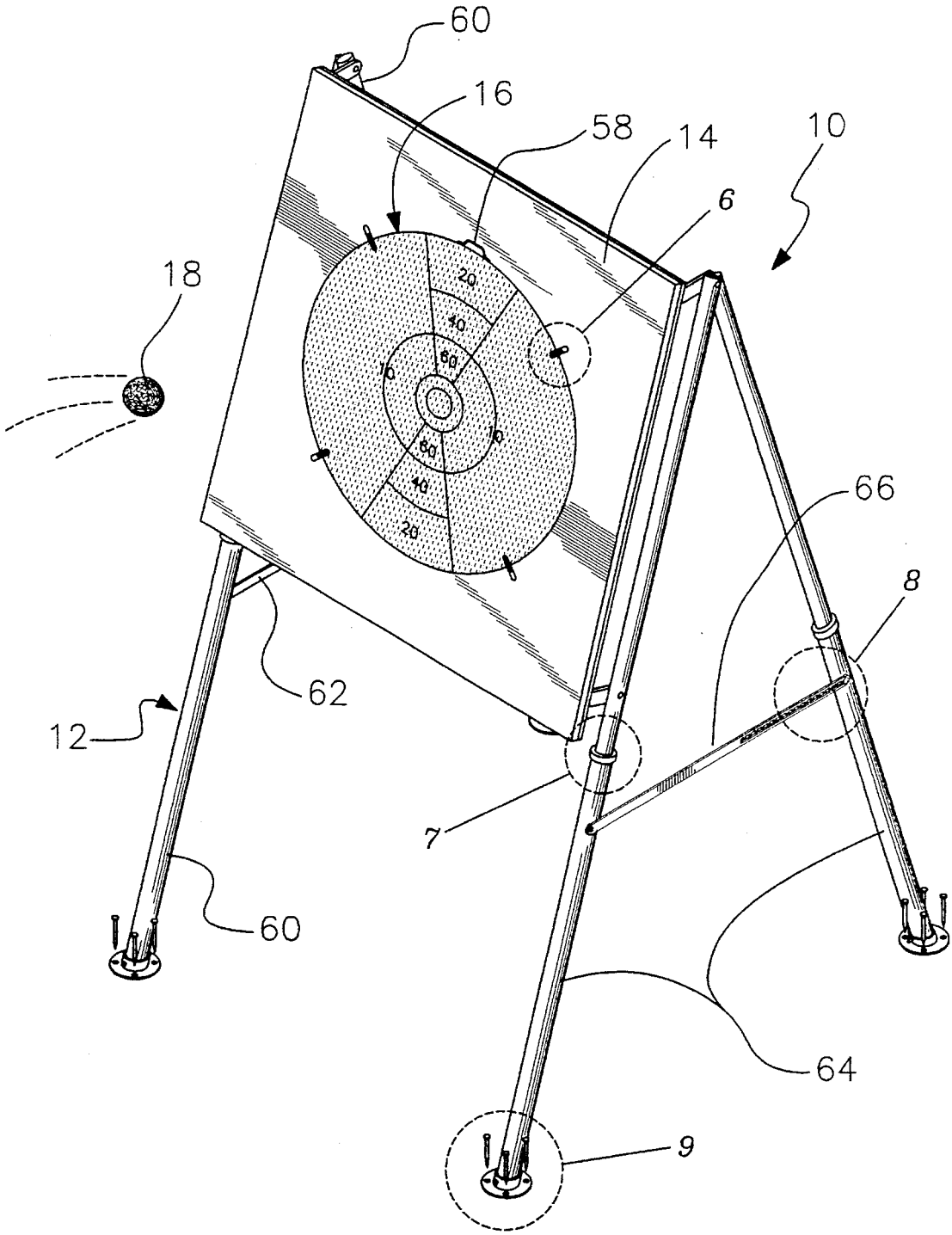
FIG. 1 is an isometric illustration of a hook and loop ball target according to the present invention.

With reference now to the drawings, and in particular to FIGS. 1–9 thereof, a new hook and loop ball target embodying the principles and concepts of the present invention and generally designated by the reference numeral 10 will be described.

More specifically, it will be noted that the hook and loop ball target 10 of the present invention comprises a support stand 12 positionable upon an unillustrated ground surface so as to extend substantially upwardly therefrom. A back board 14 is mounted to the support stand 12 and is preferably positioned in an inclined orientation so as to define an acute included angle between the back board 14 and a vertical axis extending substantially orthogonally relative to a ground surface upon which the device 10 is positioned. A target 16 is mounted to a front face of the back board 14 and comprises a hook and loop material cooperable with a ball 18 having a hook and loop material covering extending thereabout. By this structure, and individual can toss or throw the ball 18 towards the target 16, whereby removable coupling of the ball to the target will occur upon impacting of the ball against the target.

Figure 2:
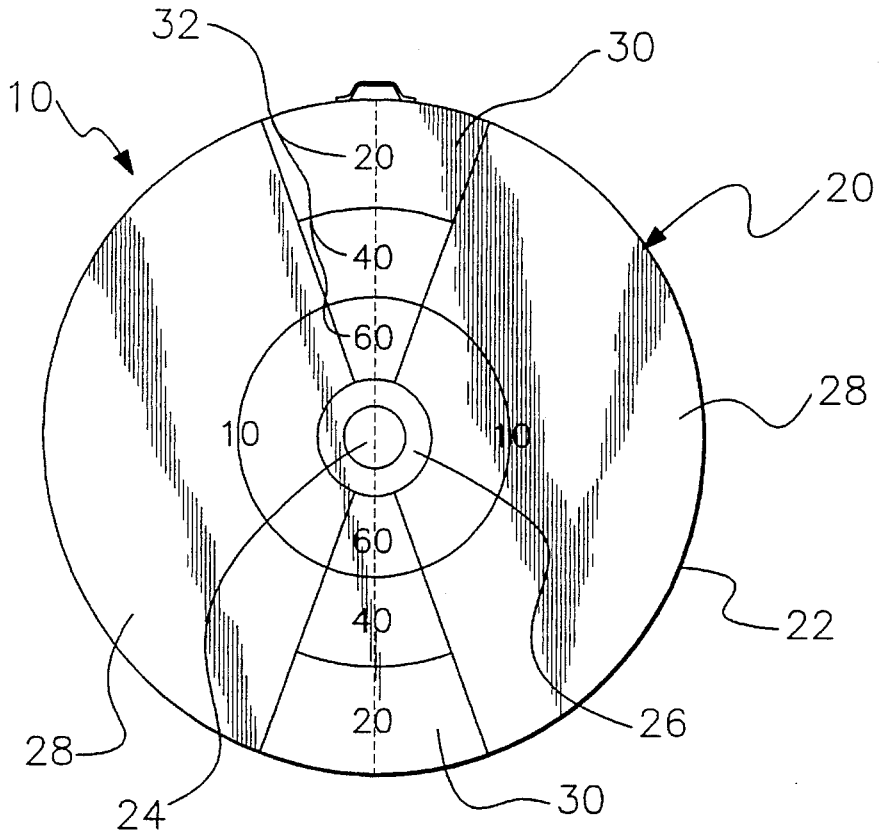
FIG. 2 is a front elevation view of a first target of the invention.

Referring now to FIG. 2, it can be shown that the target 16 may comprise a first target 20 of substantially circular configuration which includes a base web 22 of hook and loop material. Indica is printed on the base web 22 so as to facilitate play of a game. To this end, indicia is printed on the base web 22 so as to define a center circular area 24 concentrically surrounded by a center annular area 26. A first pair of diametrically opposed arcuate areas 28 extend radially outward from the center annular area 26 and are shaped so as to be of a first arcuate length. A second pair of diametrically opposed arcuate areas 30 extend from the center annular area 26 in opposite directions relative to one another and are positioned so as to reside between the first pair of diametrically opposed arcuate areas 28. The second pair of opposed arcuate areas 30 are shaped so as to be of a second arcuate length, wherein the first arcuate length is substantially greater than the second arcuate length as shown in FIG. 2 of the drawings. Further, the second pair of diametrically opposed arcuate areas 30 are each divided into a plurality of arcuate zones 32 spaced from the center annular area 26. In this form of the target 16, the first target 20 further includes a plurality of unlabeled numerical values either printed on the base web 22 or associated with the various areas and zones thereof. To this end, the center circular area 24 can be assigned a first numeric value, with the center annular area 26 being assigned a second numerical value. Further, the arcuate areas 28 and 30 can each include indica representative of various numerical values associated with the areas or zones 32 thereof.

Figure 3:
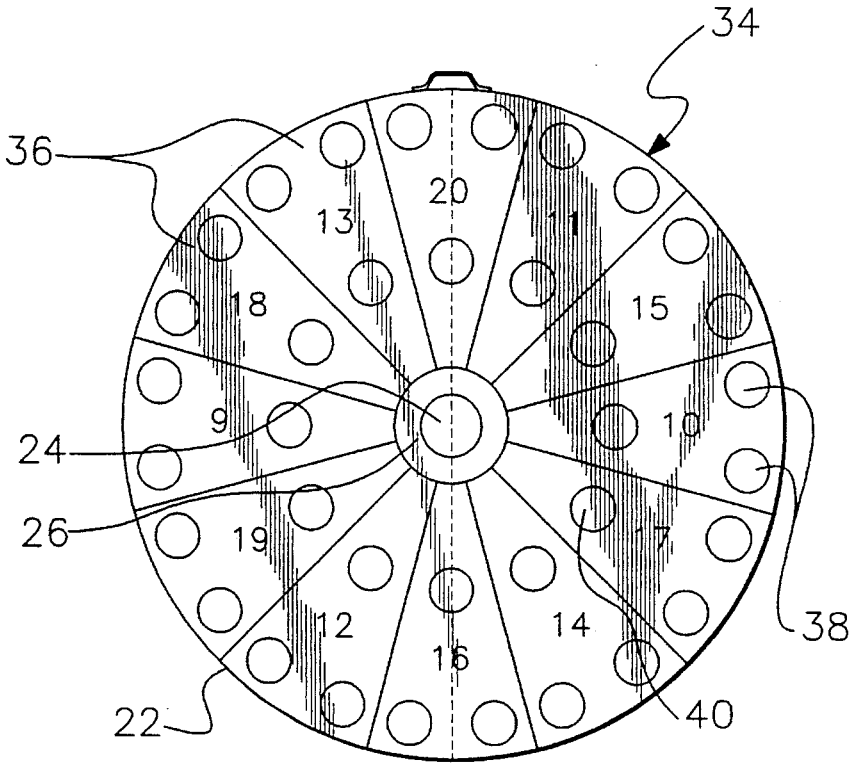
FIG. 3 is a front elevation view of a second target of the invention.

Referring now to FIG. 3, it can be shown that the target 16 may take the form of a second target 34 which includes a base web 22 of hook and loop material shaped so as to define a substantially circular shape. The indicia printed on the base web 22 of the second target 34 includes a center circular area 24 concentrically surrounded by a center annular area 26. A plurality of radially spaced arcuate areas 36 of equal arcuate length extend radially outward from the center annular area 26 and terminates at an outer periphery of the base web 22. Each of the radially spaced arcuate areas 36 includes an outer pair of circular zones 38 positioned proximal to an outer periphery of the base web 22, and a single inner circular zone 40 positioned proximal to the center annular area 26. Further, each of the plurality of radially spaced arcuate areas 36 includes an unlabeled numerical value printed therein assigning a predetermined number of points to such area. The outer pair of circular zones 38 operate to multiply a number of points awarded to a player by a predetermined amount, with the inner circular zones 40 operating to multiply a number of points awarded to a player by a further predetermined amount. For example a ball 18 landing on one of the outer pair of circular zones 38 preferably awards double a number of points indicated by the numeric value printed in the particular arcuate area 36 within which the ball is positioned. The inner circular zone 40 preferably awards three times a number of points indicated by the numeric value of the particular spaced arcuate area 36. If desired, the second target 34 and the first target 20 can be positioned on opposed faces of a single planar member interposed between the base webs 22. Alternatively, the base web 22 may simply be a double-sided base web 22, wherein the defining indica of the first target is printed on a first side of the base web and the defining indicia of the second target 34 is printed of the second side of the base web.

Figure 4:
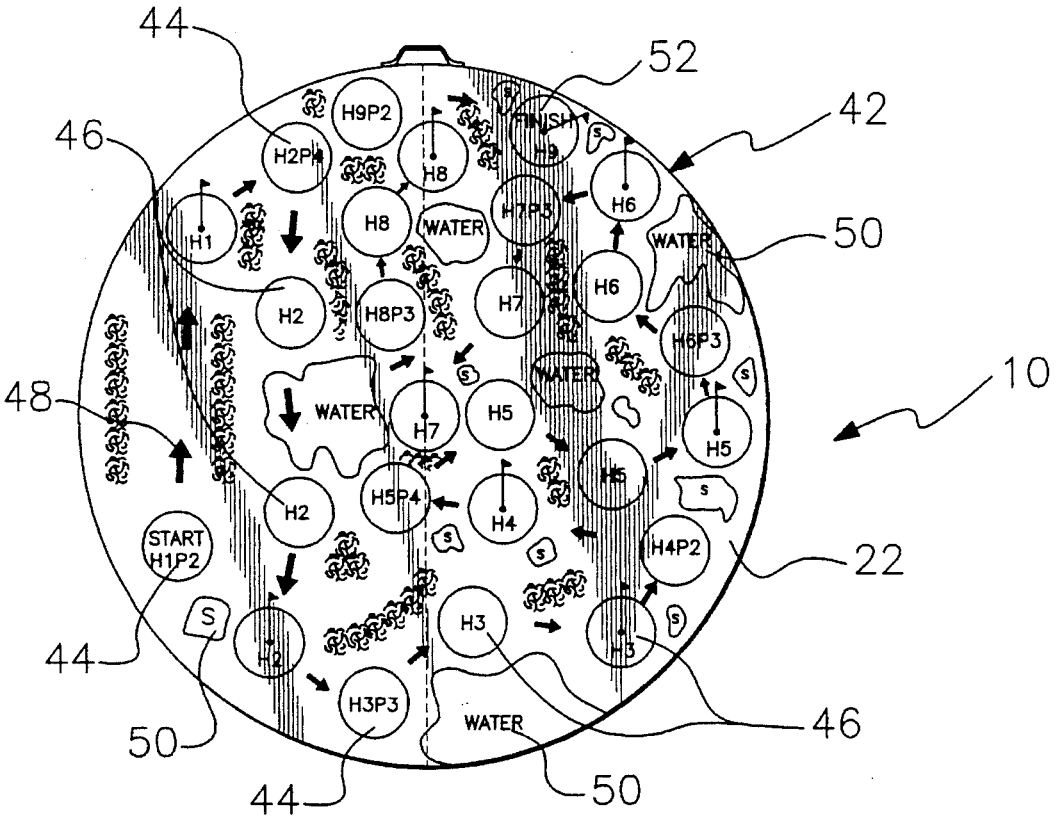
FIG. 4 is a front elevation view of a third target of the invention.

Referring now to FIG. 4, it can be shown that the target 16 may be realized in a third target 42 comprising a substantially circular base web 22 of hook and loop material. The indicia of the third target 42 facilitates play of a simulated golf game. To this end, the indicia includes a plurality of tee areas 44 which are substantially circular in shape printed upon the base web 22. Each of the tee areas 44 includes instructive indica codes indicating a sequence of the tee areas and a number of intermediate zones 46 positioned between sequential tee areas. Sequence arrows 48 direct an individual between the tee areas 44 and the interposed intermediate areas 46. A plurality of trap areas 50 of random shape are printed on the base web 22 and serve to simulate sand and water traps of a conventionally known golf course. The sequential tee ares 44 terminate at a finish area 52 denoting the last tee area. The third target 42 can be utilized by an individual to simulate a golf game during use of the device 10. To this end, the ball 18 can be thrown against the third target 42 in a manner dictated by the indica printed on each of the tee areas 44. For example, the tee 44 labeled "START H1P2" indicates to an individual that the particular tee area is hole number 1 and has a par of two. The par of two labeled on the "START" tee area 44 indicates that there will be a total of two correct throws needed to complete the hole. To this end, a first correct throw must hit the "START" tee area 44, with a second correct throw hitting the intermediate area 46 labeled "H1" to complete the hole one (1). The sequence arrows 48 thus serves to indicate the order or sequence of the intermediate areas 46 which must be adhered to during play of an associated game.

Figure 5:
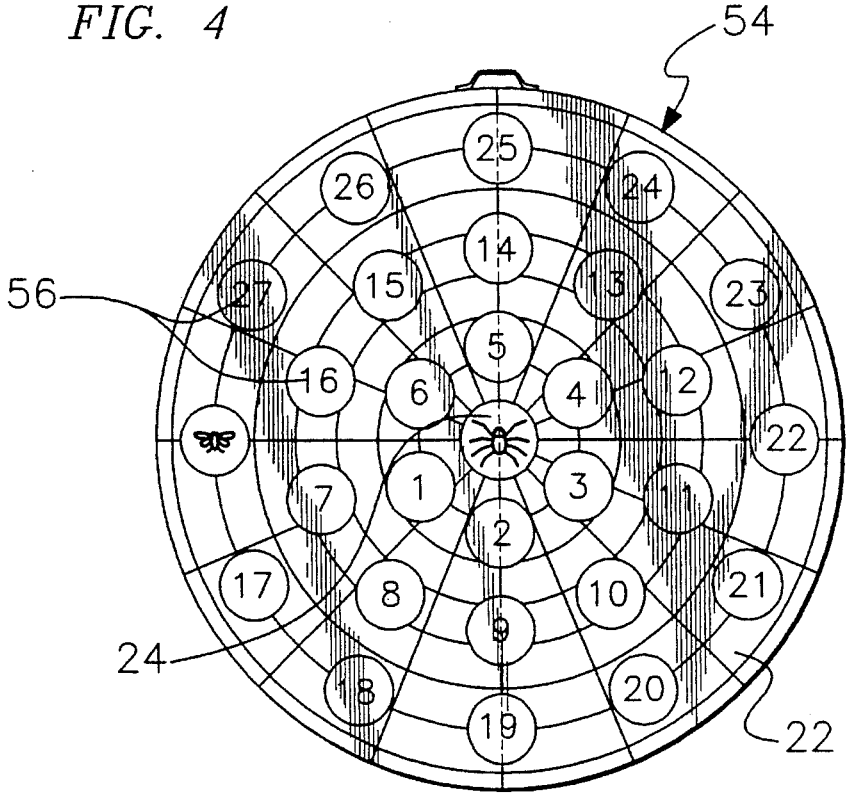
FIG. 5 is a front elevation of a fourth target of the invention.

As shown in FIG. 5, the target 16 may further comprise a fourth target 54 including a base web 22 of substantially circular shape formed from a hook and loop material. The indicia of the fourth target 54 includes a center circular area 24 and a plurality of distinct circular zones 56 arranged in concentric annular arrays positioned about the center circular area 24. Each of the circular zones 56 includes numerical indicia printed therein arranged in a spirally increasing pattern about the base web 22. The fourth target 54 facilitates play of a game wherein an individual throws the ball 18 against the target 16 and must hit the circular zones 56 in a numerically ascending sequential manner initiated by first striking the center circular area 24 to release the "SPIDER" therefrom. The players ascend spirally through the circular zones 56 to eventually capture the "FLY" printed on the last circular zone 56. The fourth target 54 can also be printed or otherwise secured to a rear surface of the third target 42 if so desired. Further, any of the target 16 may be provided with a hanging bracket 58, as shown in FIG. 1, which facilitates hanging of the target 16 from a projecting support member in the absence of the support stand 12.

Figure 10:
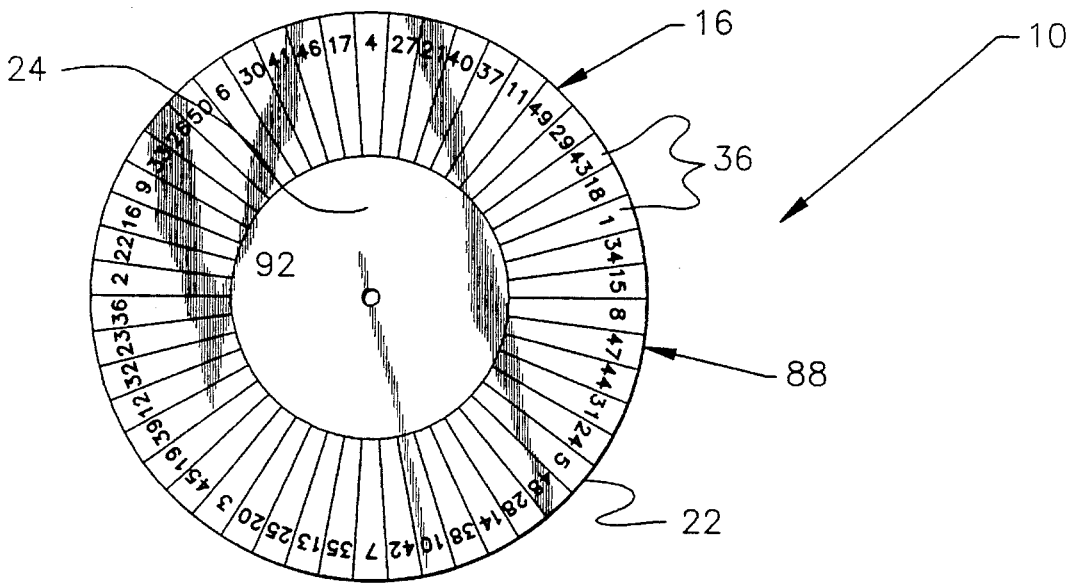
FIG. 10 is a front elevation view of a fifth target area of the target.
Figure 11:
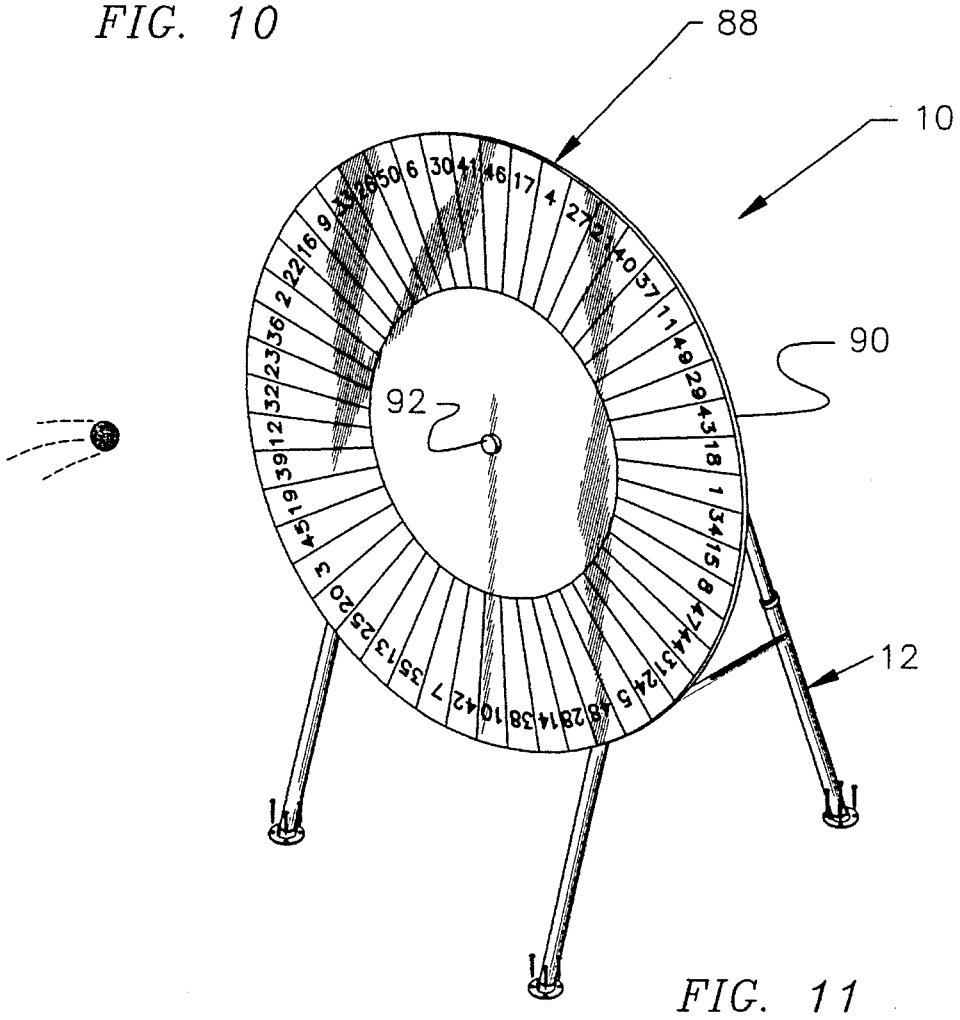
FIG. 11 is a perspective view of the fifth target area of the target.

As shown in FIGS. 10 and 11, the target 16 may alternatively further comprise a fifth target 88 including a base web 22 of substantially circular shape formed from a hook and loop material and mounted on a rigid backing panel 90. A center axle 92 is rotatably directed through a center of the base web 22 and the backing panel 90 and is rotatably coupled to the backboard 14 of the support stand 12 with suitable unillustrated bearings or bushings of conventionally known structure. The indicia of the fifth target 88 includes a center circular area 24 and a plurality of radially spaced arcuate areas 36 of equal arcuate length extending radially outward from the center annular area 26 and terminating at an outer periphery of the base web 22. Each of the radially spaced arcuate areas 36 includes an unlabeled numerical value printed therein assigning a predetermined number of points to such area. By this structure, the fifth target 88 can be manually spun so as to rotate relative to the support stand 12. A player can then throw the ball 18 at the target 16, with a number of points corresponding to the numerical value being awarded to such player in accordance with an attached position of the ball on the target within one of the radially spaced arcuate areas 36.

Figure 6:
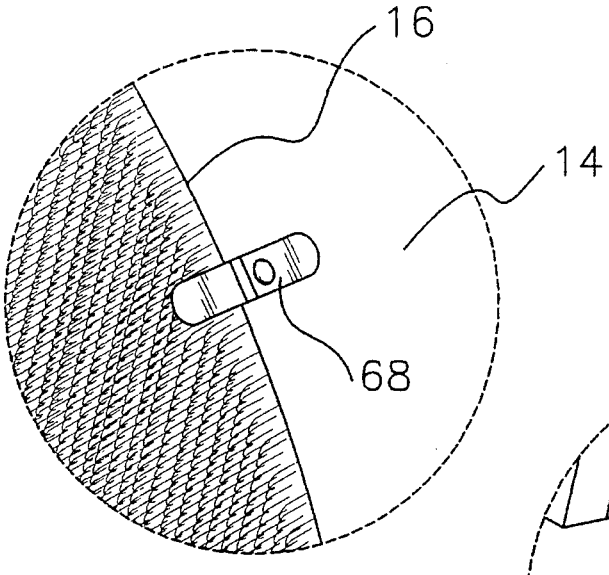
FIG. 6 is an enlarged isometric illustration of the area 6 set forth in FIG. 1.
Figure 7:
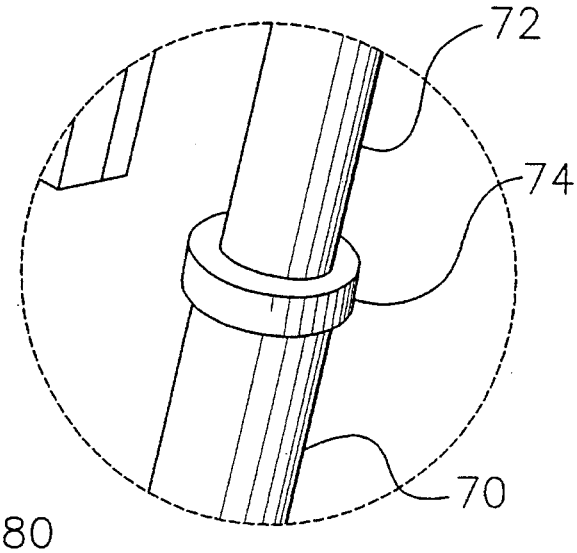
FIG. 7 is an isometric illustration of the area 7 set forth in FIG. 1.
Figure 8:
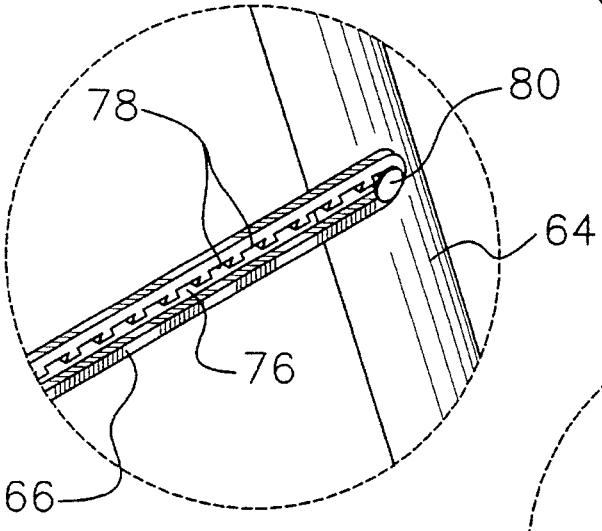
FIG. 8 is an enlarged isometric illustration of the area 8 set forth in FIG. 1.
Figure 9:
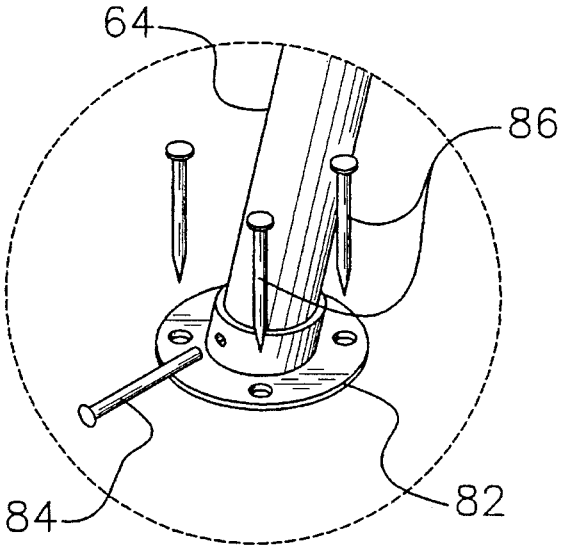
FIG. 9 is an exploded isometric illustration of the area 9 set forth in FIG. 1.

Referring now to FIGS. 6 through 9 with concurrent reference to FIG. 1, it can be shown that the support stand 12 of the present invention 10 preferably comprises a first pair of legs 60 pivotally mounted together at upper ends thereof. A first transverse brace 62 is removably positioned between medial portions of the first pair of legs 60 so as to support the lower ends thereof in a substantially spaced relationship. Similarly, the support stand 12 further comprises a second pair of legs 64 pivotally mounted together at upper ends thereof and including a second transverse brace 66 removably mounted between medial portions of the second pair of legs 64 so as to support the lower ends thereof in a spaced relationship. The back board 14 extends between the first pair of legs 60 and the second pair of legs 64 so as to support the pairs of legs 60 and 64 in a substantially spaced and parallel orientation relative to one another. As shown in FIG. 6, the target 16 is preferably removably secured to the front face of the back board 14 by a plurality of rotatable clips 68 which are pivotally mounted to the back board 14 and extend at least partially onto the target 16. As shown in FIG. 7, each of the legs 60 and 64 is preferably comprised so as to be telescopingly adjustable. To this end, each of the legs 60 and 64 preferably comprises a base tube 70 receiving a telescoping tube 72 therewithin. A compression collar 74 of conventionally known construction is threadably engaged to the base tube 70 and operates to radially compress the base tube into frictional engagement with an exterior surface of the telescoping tube 72 so as to secure the tubes 70 and 72 relative to one another. As shown in FIG. 8, the transverse braces 62 and 66 are preferably pivotally mounted to a respective one of the legs 60 and 64 and adjustably mounted to another one of the respective legs 60 and 64. To this end, and as shown for a single one of the second pair of legs 64 and the second transverse brace 66, the transverse brace is desirably shaped so as to include an adjustment slot 76 extending longitudinally therealong and having a plurality of detent notches 78 directed into contiguous communication with the adjustment slot. A projection 80 extends from one of the second pair of legs 64 and projects through the adjustment slot 76 for reception within one of the detent notches 78. By this structure, an angular orientation of one of the second pair of legs 64 can be selectively adjusted relative to another one of the second pair of legs. As shown in FIG. 9 for one of the second pair of legs 64 each of the legs 60 or 64 may include a base flange 82 mounted at a lower end thereof by a securing pin 84 directed through both the base flange and the lower end of the respective leg. A plurality of fasteners 86 can then be directed through apertures in the base flange 82 and into a ground surface so as to secure the support stand 12 relative thereto.

In use, the hook and loop ball target 10 according to the present invention can be easily utilized to effect playing of a game wherein a ball 18 is thrown towards the target 16 and caused to be removably engaged thereto. The various forms of the targets 20, 34, 42, and 54 permit a variety of games to be played.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hook and loop ball target comprising:

a support stand positionable upon a ground surface, the support stand comprises a first pair of legs pivotally mounted together at upper ends thereof, a first transverse brace removably mounted between medial portions of the first pair of legs, a second pair of legs pivotally mounted together at upper ends thereof, a second transverse brace removably mounted between medial portions of the second pair of legs, each of the legs having a base flange mounted at a lower end thereof by a securing pin, a plurality of fasteners directable through apertures in the base flange and into the ground surface for securement of the support stand relative thereto;

a back board removably mounted to the support stand between one of the first pair of support legs and one of the second pair of legs so as to support the pair of legs in a substantially spaced and parallel orientation relative to one another;

a target mounted to a front face and a rear face of the back board and including hook and loop material cooperable with a ball having a hook and loop material covering extending thereabout so as to permit removable securement of the ball to the target upon impacting of the ball against the target.

* * * * *